United States Patent [19]

Parisi

[11] 4,452,524

[45] Jun. 5, 1984

[54] ELECTROSTATOGRAPHIC REPRODUCING APPARATUS WITH SPRING LOADED PAPER PATH

[75] Inventor: Michael A. Parisi, Ontario, N.Y.

[73] Assignee: Xerox Corporation, Stamford, Conn.

[21] Appl. No.: 393,900

[22] Filed: Jun. 30, 1982

[51] Int. Cl.[3] ..... G03G 15/20

[52] U.S. Cl. ..... 355/3 FU; 355/3 R

[58] Field of Search ..... 355/3 R, 3 FU, 11, 3 DR, 355/3 SH

[56] References Cited

U.S. PATENT DOCUMENTS

| | | | |
|---|---|---|---|
| 3,743,406 | 7/1973 | Komori et al. | 355/8 |
| 3,942,785 | 3/1976 | Stange | 271/65 |
| 3,948,511 | 4/1976 | Smith et al. | 271/274 |
| 3,997,262 | 12/1976 | Doi et al. | 355/11 |
| 4,116,556 | 9/1978 | Tanaka et al. | 355/3 SH |
| 4,287,409 | 9/1981 | Auchinleck | 235/475 |

FOREIGN PATENT DOCUMENTS

| | | | |
|---|---|---|---|
| 3009122 | 9/1980 | Fed. Rep. of Germany | 355/3 R |
| 3004291 | 8/1981 | Fed. Rep. of Germany | 355/15 |

*Primary Examiner*—R. L. Moses

[57] ABSTRACT

An electrostatographic reproducing apparatus is described wherein a first frame portion and a second frame portion are oriented relative to each other to define at least in part, a copy sheet transport path with the second frame portion being pivotally mounted toward and away from the first frame portion thereby providing open and closed positions with respect to the first frame portion. The first frame portion includes at least one fixed driven sheet transport roll and the second frame portion includes at least one idler nip roll positioned opposite the sheet transport roll in the first frame portion. The second frame portion further including means to bias the second frame portion toward the first frame portion so that the idler nip roll is directly biased into driving engagement with the driven sheet transport roll in the first frame portion and the second frame portion is self-referenced against the first frame portion. In a specific embodiment the second frame portion includes a low mass radiant fuser to fix toner images to the copy sheet, and means to guide the copy sheet from the toner transfer station to the fixing station, and the first frame member contains the drive train for other functions that are performed around a rotatable imaging drum having a photoconductive insulating layer on its surface.

21 Claims, 6 Drawing Figures

ELECTROSTATOGRAPHIC REPRODUCING APPARATUS WITH SPRING LOADED PAPER PATH

REFERENCE TO COPENDING APPLICATION

Reference is hereby made to copending application Ser. No. 248,136 entitled Instant-On Radiant Fuser, filed Mar. 30, 1981 in the name of Dana G. Marsh. Reference is also made to copending application Ser. No. 393,892 filed concurrently herewith in the name of Oscar G. Hauser and entitled "Toner Containment Method and Apparatus."

BACKGROUND OF THE INVENTION

This invention relates to electrostatographic reproducing apparatus and more particularly to simple apparatus for accurately positioning at least a portion of the copy sheet path which is defined by upper and lower frame portions.

In the electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure.

Typical of the electrostatographic reproducing apparatus commercially available today are the 3100 family of products including the 3400 and 3450 available from Xerox Corporation. In each of these machines the processor section of the reproducing apparatus is divided into at least two frame portions, an upper and a lower frame portion which each contain various sections of the processing equipment. Typically, the frame portions are hinged or pivoted about one end relative to one another. In these products, the paper path is generally horizontally oriented and is relatively straight through the machine. Furthermore the paper path is typically defined by elements in both of the frame portions, and in particular, rolls forming a pair of output drive nip rolls may be positioned in both the upper and the lower frame portions. These nip rolls must be precisely registered with respect to the paper path since, if they are not, it is possible for a sheet to strike the nip above or below the nip of the rolls forming a buckle upstream in the sheet which can further cause the formation of a buckle in the radiant fuser. When a buckle is formed in the radiant fuser, the copy paper frequently comes in contact with fuser elements resulting in the potential offset of toner material to the fuser thereby contaminating the fuser and subsequent copies. One way in which the registration of the paper path is insured is to precisely fix the position of the paper path by fixing the position of the transport mechanism prior to the position of the fuser and the position of the output roll from the fuser. The output roll in the lower frame portion is positively driven by a drive train which drives elements in both the upper and the lower frame portions. The idler roll in the upper frame is spring loaded to provide the necessary tension in the nip formed between the upper roll and the lower driven roll in the lower frame portion. In such an arrangement the drive train drives elements in both the upper frame portion and the lower frame portion thereby requiring more parts in the drive train, greatly increased assembly time, and much greater constraints in the design that the fixture can take. In addition, with a more complicated drive train, there are many more things that need to require servicing or that can malfunction. This arrangement is necessary since if the top roll were driven, a very complex driving mechanism would be required since it is very complicated and difficult to drive a spring loaded roll.

PRIOR ART

U.S. Pat. No. 4,116,556 (Tanaka et al.) describes a copying machine wherein a portion of the copy paper transport, corona charge device, transfer corotron and copy paper separator are mounted in a casing which can be moved down away from the photoreceptor drum to facilitate removal of a jam copy paper in the machine. A spring may be used in the lowering mechanism as a gravity remover to reduce the weight acting on the operator during lowering. Alternatively, the spring force may be greater than the force of gravity to urge the casing upward against a stopping means.

The art is replete with devices wherein one member may be spring loaded against another member. For example, U.S. Pat. No. 3,942,785 (Stange) illustrates a sheet inverter reverser where one idler roll 36 (FIG. 2) is spring biased toward a driven roll 34.

U.S. Pat. No. 3,948,511 (Smith et al.) describes a sheet feeding device with a plurality of feed rollers mounted on a top shaft with a bottom shaft also with a plurality of rollers mounted on a spring biased into contact with the rollers in the top shaft.

In addition, U.S. Pat. No. 3,743,406 (Komori et al.) describes in FIG. 15 a document transport table wherein three springs are used in the arrangement locking the upper and lower roller groups together.

Finally U.S. Pat. No. 4,287,409 (Auchinleck) describes a card reader with specially adapted drive roller pairs wherein the upper roller is fixed and the lower pinch roll is mounted on a shaft movable relative to the drive roller which is spring biased toward the drive roll.

SUMMARY OF THE INVENTION

In accordance with the present invention, improved electrostatographic reproducing apparatus is provided. In particular, the above noted problems are overcome by providing apparatus wherein the output transport roll is fixed in its frame portion and is positively driven by the main drive system of the reproducing machine, while at the same time the lower roll becomes the idler roll and is spring biased into operative contact with the upper roll. To insure there is good alignment and no difficulties presented with regard to formation of buckles in copy sheets as a result of the rolls not being precisely registered within the paper path, the lower roll is provided in a lower frame portion which is totally biased against the upper fixed roll assembly. The lower frame portion defines at least a portion of the lower copy sheet transport system and in this manner at least a portion of the lower copy sheet transport system may be self-referenced against a fixed drive system.

The improved paper path according to the present invention is comparatively simple in construction and manufacture, as well as providing a mechanism which is relatively easy to service. Furthermore the number of precision parts required and the time of assembly with the structure according to the present invention has been substantially reduced.

In accordance with the principal aspect of the present invention, the electrostatographic reproducing apparatus comprises a first frame portion and a second frame portion orientated relative to each other to define at least in part, a copy sheet transport path, the second frame portion being pivotally mounted toward and away from the first frame portion thereby providing open and closed positions with respect to the first frame portion which includes at least one positively driven sheet transport roll, the second frame portion including at least one idler nip roll positioned in the sheet transport path opposite the sheet transport roll in the first frame portion, the second frame portion further including means to bais the second frame portion toward the first frame portion so that the idler nip roll is directly biased into driving engagement with the driven sheet transport roll in the first frame portion and the second frame portion is self-referenced against the first frame portion.

In a specific aspect of the present invention the first frame portion is on top of said second frame portion which is spring biased into engagement with the first top frame portion.

In a specific aspect of the present invention a third base frame portion is provided to which said second frame portion is pivotally mounted about an axis perpendicular to the copy sheet transport path, and said first frame portion is pivotally mounted to the third base frame portion about an axis parallel to the copy sheet transport path.

In a further aspect of the present invention, the second frame portion includes a low mass radiant fuser to fix a toner image to a copy sheet and means to guide a copy sheet from the toner image transfer station to the toner fixing station.

In a further aspect of the present invention, the first frame portion includes means to form an electrostatic latent image on an imaging member and means to develop the electrostatic latent image as well as means to drive the operational stations around a rotatable drum with a photoconductive insulating imaging layer thereon.

Accordingly, it is an object of the present invention to provide an improved copy sheet transport mechanism for an electrostatographic reproducing machine.

It is a further object of the present invention to provide an electrostatographic reproducing machine with a relatively simple drive mechanism, requiring fewer precision parts and less assembly time.

It is a further object of the present invention to provide an electrostatographic reproducing machine which has a paper transport of increased reliability.

For a better understanding of the invention as well as other objects and further features thereof, reference is had to the following drawings and description.

DESCRIPTION OF PREFERRED EMBODIMENT

The invention will now be described by reference to a preferred embodiment of the sheet feeding apparatus.

Figure 1:
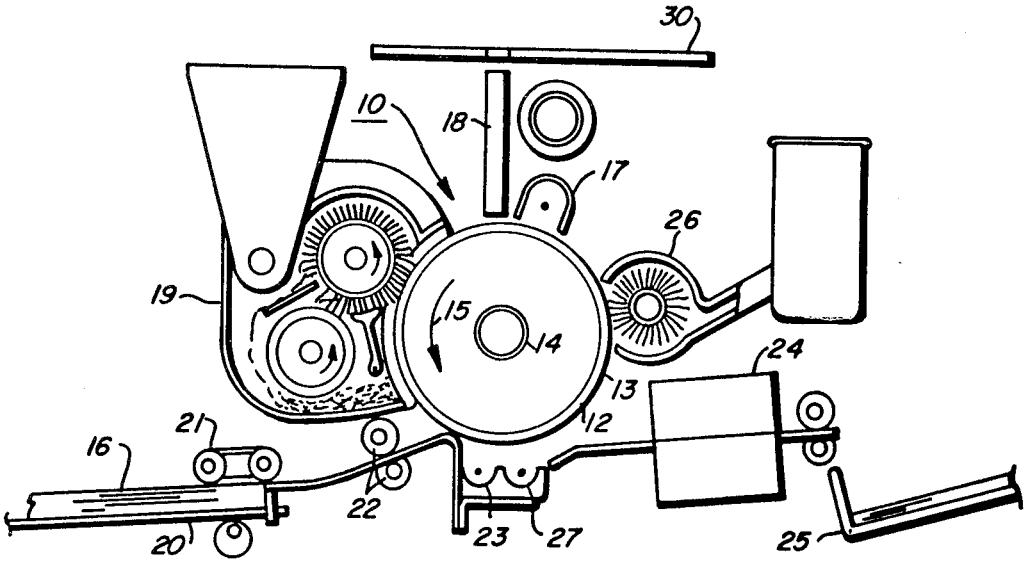
FIG. 1 is a schematic representation in cross section of an automatic electrostatographic reproducing machine with the apparatus for transporting copy sheets according to the present invention included therein.

Referring now to FIG. 1 there is shown by way of example an automatic xerographic reproducing machine 10 which includes the spring loaded paper path of the present invention. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiment or embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17 where an electrostatic charge is uniformly placed over the photoconductive surface 13 in known manner preparatory to imaging. Thereafter, the drum 12 is rotated to exposure station 18 where the charged photoconductive surface 13 is exposed to a light image of the original input scene information whereby the charge is selectively dissipated in the light exposed regions to record the original input scene in the form of an electrostatic latent image. After exposure drum 12 rotates the electrostatic latent image recorded on the photoconductive surface 13 to development station 19 wherein a conventional developer mix is applied to the photoconductive surface of the drum 12 rendering the latent image visible. Typically a suitable development station could include a magnetic brush development system utilizing a magnetizable developer mix having coarse ferromagnetic carrier granules and toner colorant particles.

Sheets 16 of the final support material are supported in a stack arrangement of an elevating stack support tray 20. With the stack at its elevated position a sheet separator feed belt 21 feeds individual sheets therefrom to the registration pinch rolls 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. Following transfer of the image the final support material which may be paper, plastic, etc., as desired is transported through detack station where detack corotron 27 uniformly charges the support material to separate it from the drum 12.

After final toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner powder image of the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as, for example, by the use of a rotating brush cleaner.

Normally, when the copier is operated in a conventional mode, the original document to be reproduced is placed image side down upon a horizontal transparent viewing platen 30 which transports the original past an optical arrangement here illustrated as Selfoc lens 18. The speed of moving platen and the speed of the photoconductive drum are synchronized to provide a faithful reproduction of the original document.

It is believed that the foregoing general description is sufficient for the purposes of the present application to illustrate the general operation of an automatic xerographic copier 10 which can embody the apparatus in accordance with the present invention.

Figure 2:
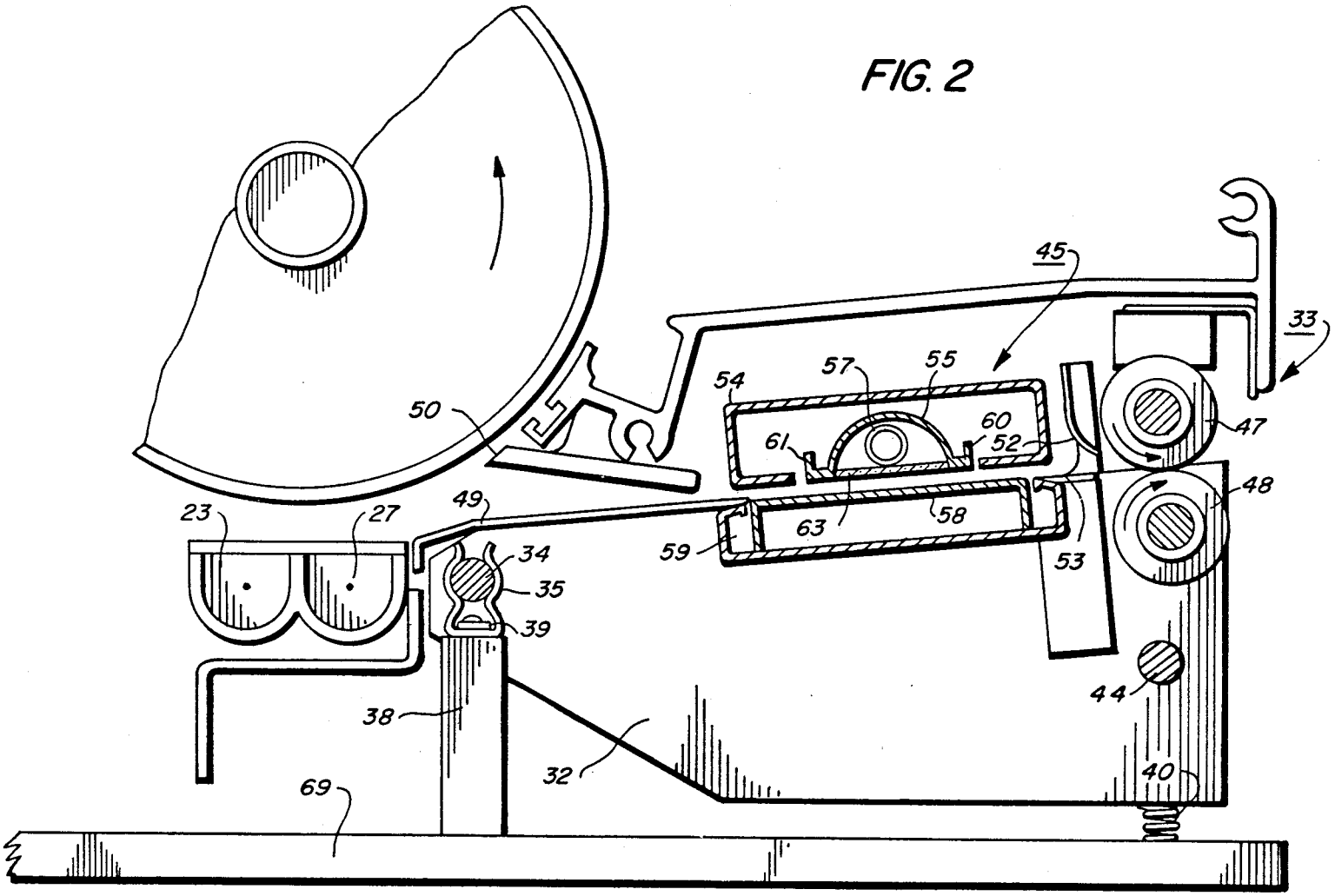
FIG. 2 is an enlarged side view of a preferred embodiment of the copy sheet transport mechanism according to the present invention.
Figure 4:
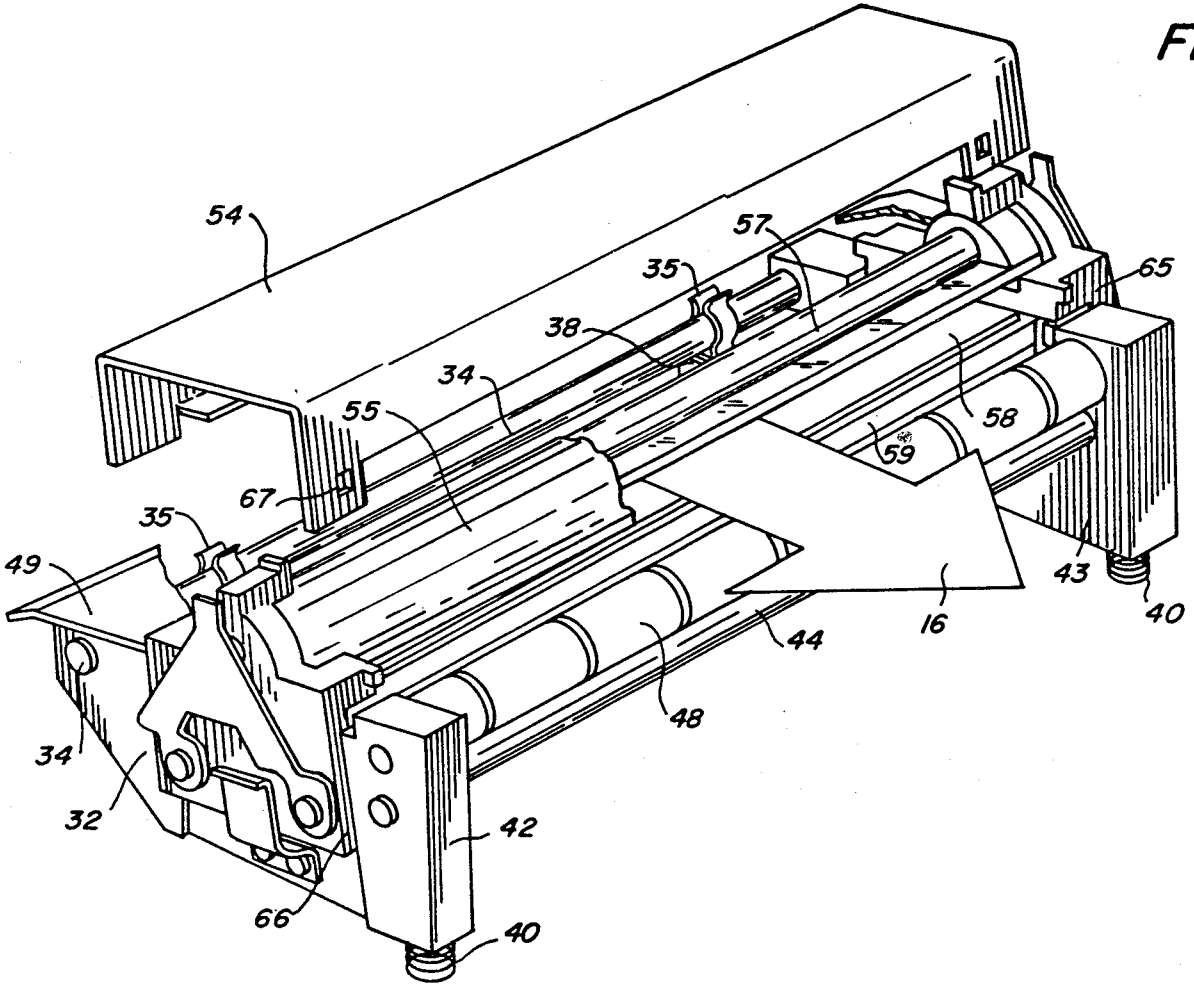
FIG. 4 is an isometric view showing a preferred embodiment of the copy sheet transport according to the present invention.

Referring now to FIGS. 2 and 4 wherein a preferred embodiment is illustrated in greater detail. A portion of the copy sheet transport path assembly 33 is defined by frame portion 32 which is pivotally mounted along an axis perpendicular to the direction of sheet transport path about tie bar 34 mounted in clips 35, one each at the inboard and outboard ends, which are firmly fixed to the lower main frame portion 69 through screws 39 in pivot supports 38. The frame portion 32 pivots about tie bar 34 and is urged upward by coil compression springs 40 one at each of the inboard and outboard sides of the machine. The inboard and outboard end caps 42 and 43 respectively of the frame portion 32 are structurally tied together by means of tie bar 44 to provide a unitized structure.

The frame portion 32 is arranged to pivot adjacent the transfer station which comprises the transfer corotron 23 and detack corotron 27, to provide a copy sheet transport path from the transfer station through the fuser 45 to the output transport rolls 47, 48. In the copy sheet path from the transfer station a copy sheet first is guided by the input baffle guide 49 which is shaped so that the leading edge is at a level below the level of the leading edge of the paper. The leading edge of the copy sheet is further guided by a plurality of front guide fingers 50 which are gently sloped toward the fuser entrance. The guide fingers 50 are part of the top frame portion as is the top fuser exit guide 52 which together with the bottom fuser exit guide 53 guides the copy sheet with the fused image thereon into the nip of the output transport rolls 47 and 48. Since the input baffle guide 49, the fuser 45 and the lower output roll 48 are all firmly fixed to the frame member 32 they are all pivotal about tie bar 34 into engagement with the driven top output roll which is firmly fixed in the top frame member. By spring biasing the section of the copy sheet path formed by frame member 32 it is insured that the possibility of a copy sheet striking on a surface which may deflect it and thereby form a buckle therein leading to the problems discussed above is substantially reduced. This is particularly true with respect to a copy sheet striking the output roll at a position other than a nip therebetween since the nip is precisely positioned relative to the path of the copy sheet. Further assurance of this may be achieved if at each transition in the paper path the level of the downstream section is slightly below the level of the upstream section. In this way the level of the input baffle guide 49 would be below the level of the platform in the transfer detack station and the level of the fuser platen 58 would be below the level of the downstream end of the input baffle guide.

Figure 5:
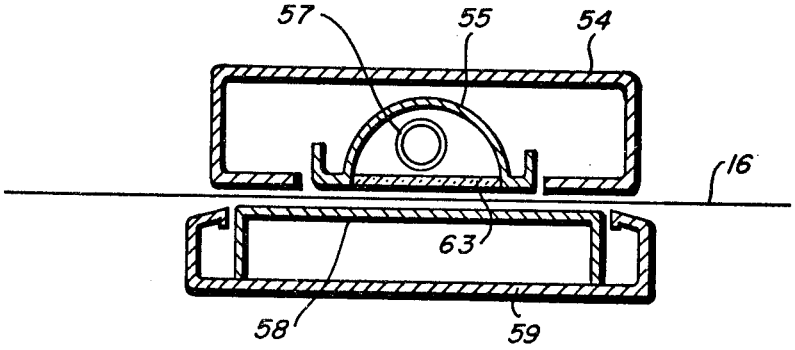
FIG. 5 is a side view of a low mass radiant fuser that may be used in the technique according to the present invention.

With continued reference to FIGS. 2, 4, and 5 the fuser will be discussed in greater detail. In FIG. 4, the paper 16 bearing the toner image on its upper surface is seen passing through the fuser apparatus. The portion of the fuser apparatus above paper 16 is made of a housing 54, a reflector means 55, and a source of radiant energy 57. The portion of the fuser apparatus below paper 16 is made of a platen 58 and platen housing 59. Housings 54 and 59 are essentially in the shape of a channel. They may be made of any suitable material such as relatively thin gauge aluminum, for example, 0.032 inch thick aluminum. When aluminum or other thermally conductive material is used in making housings 54 and 59, the housings should be thermally spaced from the reflector means 55 and platen 58, respectively. In FIG. 2, the two end legs of the channel comprising housing 54 are shown to terminate before they reach reflector means 55. In this manner, housing 54 and reflector means 55 are thermally spaced by a thin layer of air. Alternatively, reflector means 55 may be thermally spaced from housing 54 by means of a thin coating of asbestos or other thermally insulating material on end surfaces 60 and 61. Similarly, the ends of housing 59 also may be insulated from platen 58 to enable the platen to be rapidly warmed up from ambient temperature. The thermal spacing between reflector means 55 and the housing 54, and between platen 58 and housing 59 is one element of the fuser enabling the instant radiant fuser apparatus to require no standby power and yet be substantially instantly available for fusing.

The reflector means 55 preferably is made of a very low mass reflector material such as 0.012 inch thick (8–12 mils) specular aluminum or is 0.002–0.004 inch thick specular stainless steel.

To achieve the instant-on capability of the radiant fuser, yet without the use of a pulse of high power as in a flash fuser and without the use of standby power, the major components of the radiant fuser must attain their operating temperatures, from an ambient start, in the few seconds between the time an operator activates the "Start" button and the point when the toner image arrives at the fusing station. In a desk-top copier, this period may be, for example, 3–5 seconds. Since in a radiant fuser the reflector typically provides between about one fourth to one half of the total heating energy needed for fusing, it is important that the reflector substantially achieves its operating temperature in about 4 seconds or so. The very low mass reflector, as described and thermally spaced from the relatively higher mass lower temperature housing, can be heated from an ambient temperature of say 65° F. to an operating temperature in excess of 400° F. in about 4 seconds, with the use of only the normal heating lamp for the radiant fuser, that is, without the use of auxiliary heating means.

The source of radiant energy 57 may be an infrared heater such as a quartz lamp. Typically, a lamp having a power between 400 to 800 watts would give adequate fusing in the instant-on radiant fuser apparatus, depending on the speed of advancement of the paper 16 through the fuser apparatus. A shield for the quartz lamp, such as a quartz shield 63, may be provided to shield the lamp and the reflector means from the paper, debris and other machine impurities. Such a quartz shield is substantially transparent to the infrared radiation and it is known to those skilled in this art.

The platen 58 is intended to support and guide the paper 16 through the fuser apparatus. The present instant-on radiant fuser apparatus does not depend on platen 58 to provide a portion of the thermal energy to paper 16 in order to fuse the toner image thereon. Thus, platen 58 is constructed so that it can be warmed by lamp 57 in the 3–5 seconds that are available between the time when an operator pushes the Start button on the copying machine and the time when paper or substrate 16 enters the fuser apparatus. During that period of time, platen 58 is warmed or heated by lamp 57 to a temperature somewhat above the temperature of paper 16 in the fuser apparatus. With a quartz lamp 57 of about 450 watts power, the platen 58 will reach a temperature of about 300° F., and the reflector 55 will be above about 400° F.

I prefer to make the platen out of thin gauge aluminum, for example, 0.008–0.012 inch thick aluminum. The side of the platen facing the quartz lamp should be covered with an energy absorbing material, such as a dark colored high temperature paint, to maximize the absorption of thermal energy. I have found that a pigmented, highly crosslinked polysiloxane marketed by the Dow Corning Company under its trademark Vestar is very suitable for this purpose. Another example of a useful platen is one made of dyed or anodized aluminum.

Since the first sheet of paper will reach the fuser apparatus in about 4 seconds after an operator has activated the Start button on the copying machine, the instant-on radiant fuser apparatus must attain its operating temperatures during those few seconds. By means of an extremely low mass reflector means 55, the heat absorbing low mass platen 58, the thermal spacing between the reflector means 55 and the housing 54, and the thermal spacing between the low mass platen 58 and the platen housing 59, the instant-on radiant fuser apparatus is able to achieve the operating temperatures in those few seconds. When the toner image on paper 16 is being fused, the temperature of the reflector means 55 must be controlled so that the quartz lamp 57 will not damage the reflector means 55. This is accomplished by circulating cooling air in the conduit formed by the housing 54 and reflector means 55. Similarly, cooling air is provided to platen 58 through the conduit formed by platen 58 and housing 59, to control the temperature of the platen within acceptable limits. For maximum effectiveness, the cooling air should be of a volume to create turbulent flow conditions in the conduits.

As shown in FIG. 4, the quartz lamp 57, reflector 55, platen 58, and platen housing 59 are all mounted in end blocks 64, 65 which in turn are mounted in end caps 42, 43 respectively, and held in position by clip 66. The fuser housing 54 fits over the rest of the fuser and snaps into place in holes 67. For further details of the low mass radiant fuser attention is directed to application Ser. No. 248,136 the total disclosure of which is entirely incorporated herein by reference.

Figure 3:
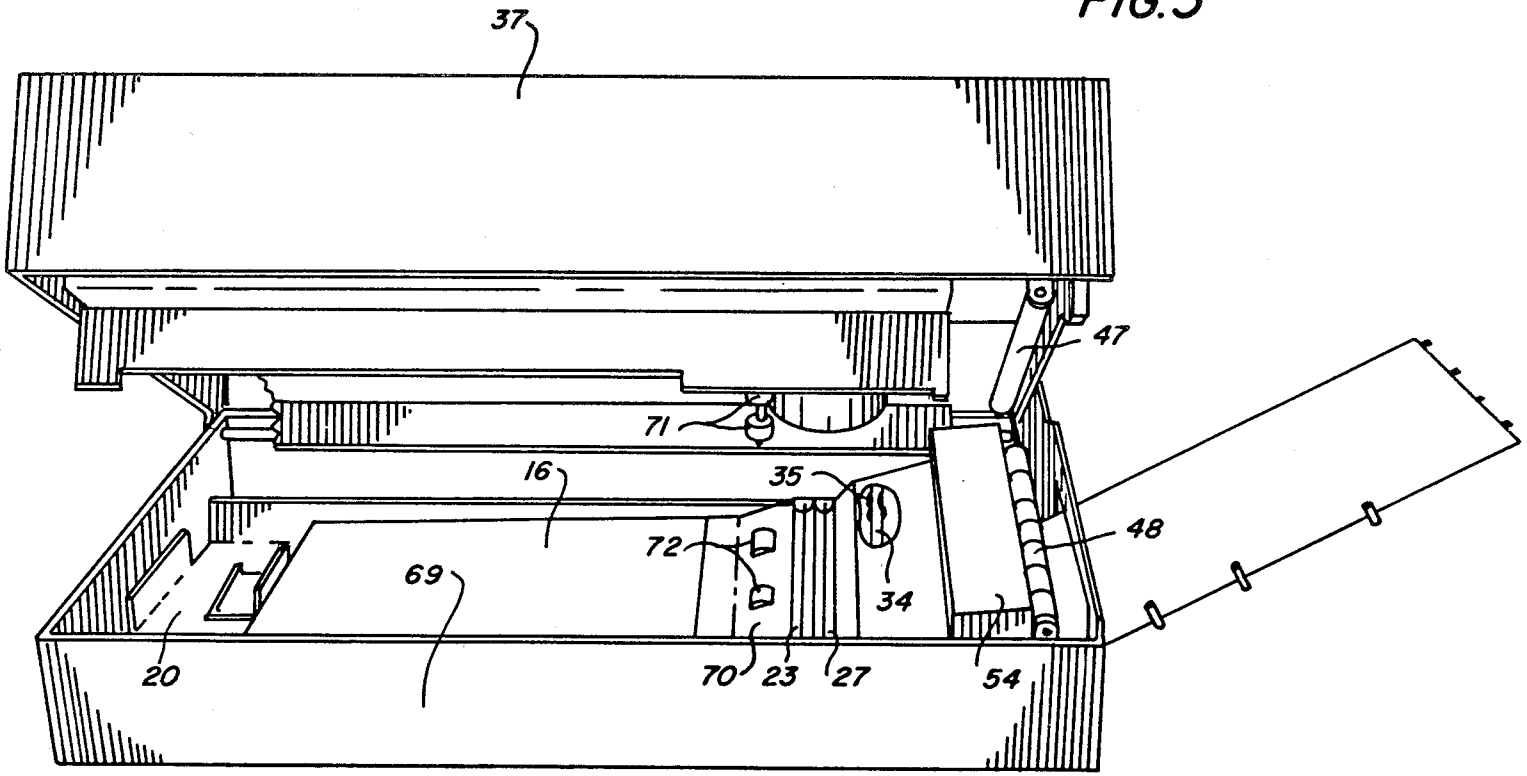
FIG. 3 is an isometric view showing the opening and closing arrangements of the three frame members that are used in a preferred embodiment according to the present invention.

With reference to FIG. 3 the position of the three frame portions of the apparatus according to the present invention is illustrated in greater detail. The base frame portion 69 houses the copy sheet supply tray 20, a copy sheet guide 70 and an idler roll 71 of registration feed roll pair 72, which is spring biased by means not shown against the fixed registration feed roll in the upper main frame portion 37 when the frames are in the closed position. In addition, the transfer corotron 23 and the detack corotron 27 are mounted in the base frame member as is the pivotally mounted copy sheet path according to the present invention.

With continued reference to FIG. 3, it will be seen that the upper main frame portion 37 is pivotally mounted to the base frame portion 69 along the outboard side in a direction parallel to the copy sheet feeding direction. The remainder of the operational systems, subsystems and components illustrated in FIG. 1 which are not mounted or housed in the copy sheet path frame portion 32 and base frame portion 69 are mounted or housed in main frame portion 37. All the image fusing, developing and cleaning elements, together with the document transport are housed in the main frame portion. It also provides a frame support for the copy sheet separator feeder, it being noted that the copy sheets 16 in supply tray 20 are spring loaded into engagement with the separator feeder by means not shown. Also provided in the upper main frame portion 37 is a driven registration feed roll 72 which forms a nip with idler roll 71 in the base frame portion. It will be observed with this construction that all the operational elements or systems which are required to be driven are mounted or housed in the upper main frame portion. This enables a relatively straight forward design for the machine drive train, with fewer parts, shorter assembly time, reduced maintenance, and fewer precision parts. The drive train (not illustrated) may comprise a single drive motor from which through a series of belts gears and clutches, the rotatable drum, developer roll, cleaning brush, for example, may be driven. In addition it is considerably cheaper to reference the copy sheet path illustrated as frame portion 32, against the main frame portion rather than provide precision parts to precisely position a fixed copy sheet path. As will also be appreciated the top output roll 47 which is fixedly mounted and partially driven in main frame portion 37 is in driving engagement with the lower idler roll 48 which is fixedly mounted in frame portion 32. With the aid of springs 40 the copy sheet path frame portion 32 is biased upwardly so that idler roll 48 is in driving engagement with the top driven roll 47, and the frame portion 32 is self-referenced against the main frame portion. In this manner the upper main frame portion 37 acts as a prime reference which allows the copy sheet frame portion 32 to self align against the main frame portion 37 rather than being precisely positioned by precision parts.

While the biasing means has been illustrated as a coil compression spring 40 it will be understood that any suitable biasing means may be used as long as it urges the frame 32 into engagement with the fixed driven output roll 47. For example, a pair of leaf springs would work equally as well.

Figure 6:
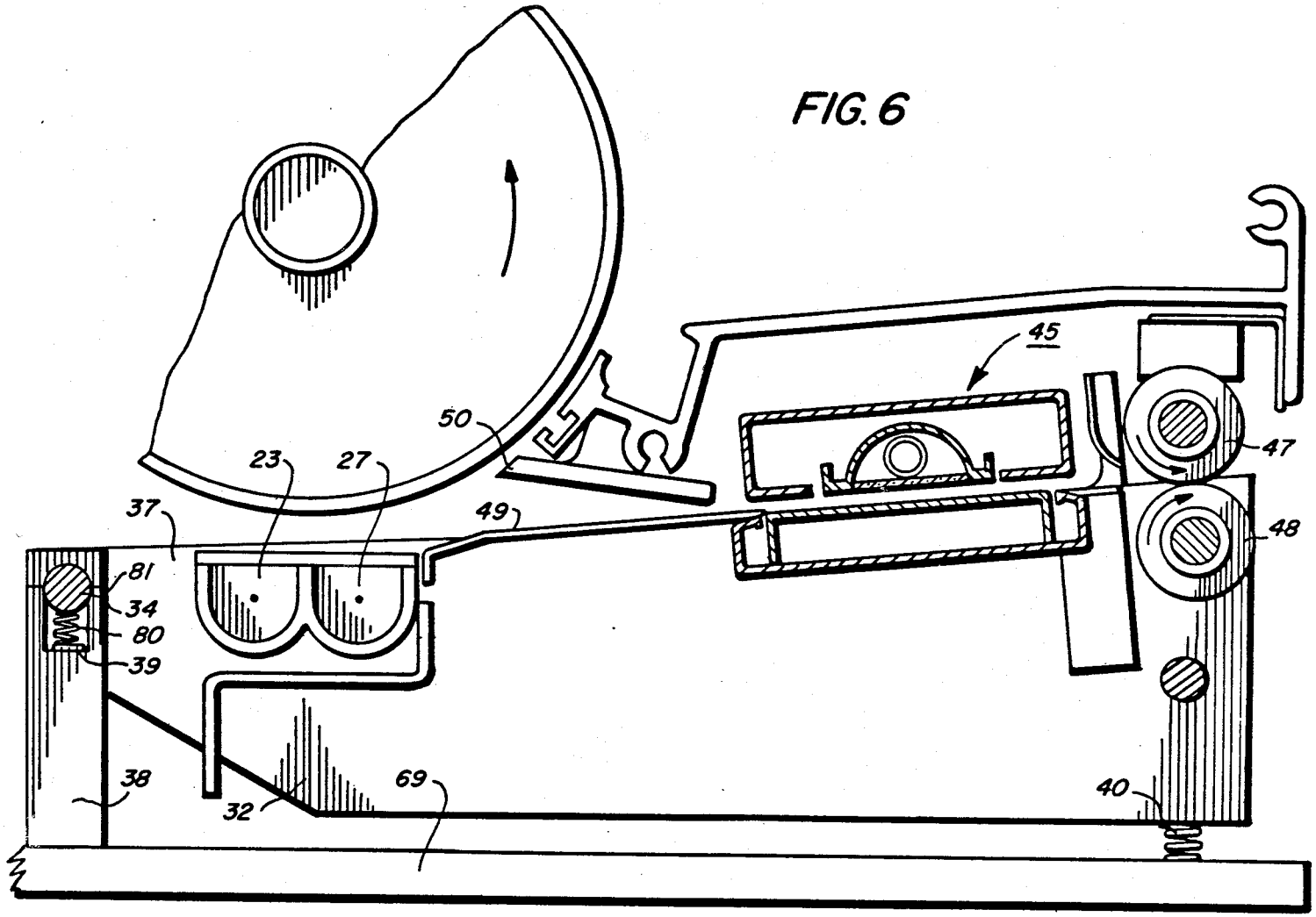
FIG. 6 is an enlarged side view of an alternative embodiment of the copy sheet transport according to the present invention.

Attention is now directed to FIG. 6 which illustrates an alternative embodiment of the present invention. In this embodiment the copy sheet frame portion 37 now includes the transfer and detack corotrons 23, 27 as well as a portion of the post registration pre transfer copy sheet path. The copy sheet frame portion 32 is now suspended by the two springs 40 at the output end of the frame in the manner illustrated with reference to FIG. 2, and also by two springs 80, one at each end, in the bottom of the tie bar channel 81, one at each end, which is fastened to the pivot supports 38 by screws 39. In this way the tie bar 34 is allowed to move up and down in the channels 81 and the copy sheet frame portion 32 is urged upward toward engagement with upper main frame 37. In particular the copy sheet frame portion 32 and all the components mounted to it will align or self reference itself to the drum 12 as well as the output rolls 47.

While the above invention has been described with reference to specific embodiments, it will be apparent to those skilled in the art that many alternative, modifications and variations may be made. For example, while the invention has been described in one embodiment with reference to a horizontal sheet transport assembly the principal will work equally well in a substantially vertical sheet transport assembly. In addition, while the invention has been described with reference to a rotatable drum providing a reusable imaging surface the principal will work equally well with an electrostatographic imaging system employing a single use photoconductive layer such as zinc oxide sheets which are commercially available. Accordingly it is intended to embrace all such alternatives and modifications as may fall within the spirit and scope of the appended claims.

I claim:

1. An electrostatographic reproducing apparatus comprising first, second frame portions and a third base frame portion said first frame portion and said second frame portion being oriented relative to each other to define at least in part a copy sheet transport path, said second frame portion being pivotally mounted to said third base frame portion about an axis perpendicular to the copy sheet transport path to move toward and away from said first frame portion to provide open and closed positions with respect to said first frame portion, said first frame portion including at least one positively driven fixed sheet transport roll, said second frame portion including at least one idler nip roll positioned in said sheet transport path opposite said driven sheet transport roll in said first frame portion and including means to bias said second frame portion toward said first frame portion so that said idler nip roll in said second frame portion is directly biased into driving engagement with said driven sheet transport roll in said first frame portion to thereby self reference said second frame portion against said first frame portion.

2. The reproducing apparatus according to claim 1 wherein said first frame portion is pivotally mounted to said third base frame portion about an axis parallel to the copy sheet transport path.

3. The reproducing apparatus according to claim 1 wherein said means to bias includes a spring.

4. The reproducing apparatus according to claim 3 wherein said first frame portion is on top of said second frame portion when they are in the closed position.

5. The reproducing apparatus according to claim 1 wherein said second frame portion includes means to fix a toner image to a copy sheet positioned in said copy sheet transport path upstream of at least one idler roll and means to guide a copy sheet from a toner image transfer station to said toner fixing means.

6. The reproducing apparatus according to claim 5 wherein at each transition in the paper path the level of the downstream section is below the level of the upstream section.

7. The reproducing apparatus according to claim 1 wherein said first and second frame portions are oriented to provide a generally horizontal transport path for the copy sheet.

8. The reproducing apparatus according to claim 1 wherein said first frame portion includes means to form an electrostatic latent image on an imaging member and means to develop said latent image with toner.

9. The reproducing apparatus according to claim 8 wherein said imaging member comprises a rotatable drum with a photoconductive insulating image surface layer and said means to form an electrostatic latent image comprises means to uniformly charge the photoconductive insulating layer and expose it to a light and shadow pattern including means to clean said drum after the said toner image has been transferred to a copy sheet.

10. The reproducing apparatus according to claim 1 wherein said third base frame portion includes copy sheet supply means, copy sheet feed means, means to transfer a toner image from said drum to said copy sheet.

11. The reproducing apparatus according to claim 10 wherein said third base frame portion includes means to electrostatically detack a copy sheet from said rotatable drum.

12. The reproducing apparatus according to claim 8 wherein said first frame portion includes drive means to drive said at least one copy sheet transport roll.

13. The reproducing apparatus according to claim 9 wherein said first frame portion includes drive means to drive said at least one copy sheet transport roll, said rotatable drum, said developer means and said cleaning means.

14. The reproducing apparatus according to claim 5 wherein said second frame portion includes means to transfer a toner image from said drum to said copy sheet.

15. The reproducing apparatus according to claim 14 wherein said second frame portion further includes means to electrostatically detack a copy sheet from said rotatable drum.

16. The reproducing apparatus according to claim 15 wherein said second frame portion further includes means to transport a copy sheet from a copy sheet registration point through the toner image transfer zone.

17. The reproducing apparatus according to claim 5 wherein said means to fix comprises an instant-on radiant fuser apparatus, which comprises:

a first housing;

a low mass reflector means thermally spaced from said first housing, said reflector means being constructed to achieve operating temperature conditions within a few seconds without the use of standby heating devices;

said first housing and said reflector means together forming a conduit for the passage of a cooling medium therein;

a second housing;

a low mass platen facing said reflector means and spaced therefrom, said platen being thermally spaced from said second housing and being constructed to achieve operating temperature conditions within a few seconds without the use of standby heating device;

said second housing and said platen together forming a conduit for the passage of a cooling medium therein; and a source of radiant energy positioned adjacent said reflector means and between said reflector means and said platen.

18. The reproducing apparatus according to claim 17 wherein said low mass reflector means is a thin gage metallic reflector.

19. The reproducing apparatus according to claim 16 wherein said low mass platen is made of a thin gage metallic material having on its surface an energy absorbing material.

20. The reproducing apparatus according to claim 19 wherein said pigmented energy absorbing material is a black pigmented polysiloxane.

21. The reproducing apparatus according to claim 17 further comprising means for supplying air to said conduits as the cooling medium at a rate to create turbulent flow in said conduits.

* * * * *